US006165657A

United States Patent [19]

Yoon et al.

[11] Patent Number: 6,165,657

[45] Date of Patent: Dec. 26, 2000

[54] METHOD OF ELECTROPHOTOGRAPHICALLY MANUFACTURING A LUMINESCENT SCREEN ASSEMBLY FOR A CRT AND A CRT COMPRISING A LUMINESCENT SCREEN ASSEMBLY MANUFACTURED BY THE METHOD

[75] Inventors: Sang Youl Yoon; Dong Ky Shin; Hyo Sup Lee, all of Kyungsangbuk-do, Rep. of Korea

[73] Assignee: Orion Electric Co., Ltd., Kyungsangbuk-do, Rep. of Korea

[21] Appl. No.: 09/141,940

[22] Filed: Aug. 27, 1998

[30] Foreign Application Priority Data

Aug. 30, 1997 [KR] Rep. of Korea ..... 97-43639

[51] Int. Cl.[7] ..... G03G 13/22

[52] U.S. Cl. ..... 430/27; 430/25; 430/26; 430/29

[58] Field of Search ..... 430/15, 23, 24, 430/25, 26, 27, 28, 29; 313/466, 473, 474

[56] References Cited

U.S. PATENT DOCUMENTS 5,476,737 12/1995 Kusunoki et a. ..... 430/23
5,952,137 9/1999 Hara et al. ..... 430/27

*Primary Examiner*—Janis L. Dote
*Attorney, Agent, or Firm*—Notaro & Michalos P.C.

[57] ABSTRACT

A method of electrophotographically manufacturing a viewing screen including a filter layer of pigment particles for a cathode-ray tube (CRT), which comprises the steps of first-coating of volatilizable conductive layer, second-coating the conductive layer with a volatilizable photoconductive layer, first-establishing a uniform electrostatic charge over the whole surface of the photoconductive layer, first-exposing selected areas of the photoconductive layer to a light source, first-developing the discharged, exposed areas with one kind of charged pigment particles, and fixing the developed pigment particles to the photoconductive layer to form a filter layer beneath one of first to third color-emitting phosphor particles. Then, the one of first to third color-emitting phosphor particles is formed on the filter layer by a electrophotographically manufacturing method.

8 Claims, 5 Drawing Sheets

METHOD OF ELECTROPHOTOGRAPHICALLY MANUFACTURING A LUMINESCENT SCREEN ASSEMBLY FOR A CRT AND A CRT COMPRISING A LUMINESCENT SCREEN ASSEMBLY MANUFACTURED BY THE METHOD

FIELD OF THE INVENTION

The present invention relates to a method of electrophotographically manufacturing a viewing screen for a cathode-ray tube(CRT), and more particularly to electrophotographically manufacturing process of the screen including a filter layer of pigment particles, which can be formed beneath color-emitting phosphor particles using the electrophotographically manufacturing method and improve its color purity.

BACKGROUND OF THE INVENTION

Referring to FIG. 1, a color CRT 10 generally comprises an evacuated glass envelope consisting of a panel 12, a funnel 13 sealed to the panel 12 and a tubular neck 14 connected by the funnel 13, an electron gun 11 centrally mounted within the neck 14, and a shadow mask 16 removably mounted to an inner sidewall of the panel 12. A three color phosphor screen is formed on the inner surface of a display window or faceplate 18 of the panel 12.

The electron gun 11 generates three electron beams 19*a* or 19*b*, said beams being directed along convergent paths to the shadow mask 16 by means of several lenses of the gun and a high positive voltage applied through an anode button 15 and being deflected by a deflection yoke 17 so as to scan over the screen 20 passing through apertures or slits 16*a* formed in the shadow mask 16.

In the color CRT 10, the phosphor screen 20, which is formed on the inner surface of the faceplate 18, comprises an array of three phosphor elements R, G and B of three different emission colors arranged in a cyclic order of a predetermined structure of multiple-stripe or multiple-dot shape and a matrix of light-absorptive material(black matrix) 21 surrounding the phosphor elements R, G and B, as shown in FIG. 2.

A thin film of aluminum 22 or electro-conductive layer, overlying the screen 20 in order to provide a means for applying the uniform potential applied through the anode button 15 to the screen 20, increases the brightness of the phosphor screen, prevents ions from damaging the phosphor screen and prevents the potential of the phosphor screen from decreasing. And also, a resin film 22' such as lacquer is applied to the phosphor screen 20 before forming the aluminum thin film 22, so as to enhance the flatness and reflectivity of the aluminum thin film 22, then being baked and driven off for a CRT's longer life after forming the aluminum film 22.

In a photolithographic wet process, which is well known as a prior art process for forming the phosphor screen, a slurry of a photosensitive binder and phosphor particles is coated on the inner surface of the faceplate. It does not meet the higher resolution demands and requires a lot of complicated processing steps and a lot of manufacturing equipments with the use of a large quantity of clean water, thereby necessitating higher cost in manufacturing the phosphor screen. In addition, it discharges a large quantity of effluent such as waste water, phosphor elements, 6th chrome sensitizer, etc.

To solve or alleviate the above problems, an improved process of electrophotographically manufacturing the screen utilizing dry-powdered phosphor particles is developed.

U.S. Pat. No. 4,921,767, issued to Datta at al. on May 1, 1990, discloses the improved method of electrophotographically manufacturing the phosphor screen assembly using dry-powdered phosphor particles through a series of steps as is briefly explained in the following.

The method comprises the steps of: (a) coating said inner surface of the panel with a volatilizable conductive layer; (b) overcoating said conductive layer with a volatilizable photoconductive layer, the volatilizable photoconductive layer containing a material responsive to visible light; (c) establishing a substantially uniform electrostatic charge on said photoconductive layer; (d) exposing selected areas of the volatilizable photoconductive layer to visible light, so as to selectively discharge the electrostatic charges from the volatilizable photoconductive layer; (e) applying a triboelectrically charged first color emitting phosphor onto said exposed, selected areas of the photoconductive layer; (f) fixing said U first color emitting phosphor onto said photoconductive layer; (g) repeating steps (c), (d), (e), and (f), consecutively, for triboelectrically charged second and third color emitting phosphors to form a luminescent screen comprising picture elements of triads of color-emitting phosphors; (h) aluminizing said luminescent screen; and (i) baking said faceplate panel to remove the volatilizable constituents from said luminescent screen to form said luminescent screen assembly. The same process of the above steps can be repeated also for the black matrix particles before or after the three different phosphor particles are formed, thereby forming a screen array 20 of light-absorptive material 21 and three phosphor elements R, G and B in FIG. 2.

The conventional method of electrophotographically manufacturing the phosphor screen assembly using dry-powdered phosphor particles as described above has one problem that it requires dark environment during all the steps until the fixing step after the photoconductive layer is formed, because the photoconductive layer is sensitive to the visual light. Also, the fixing step is still necessary even after the developing step.

To overcome this problem, the applicant proposed a method of forming the photo-conductive layer using a photo-conductive solution responsive to the ultraviolet rays.

The solution for the photo-conductive layer 134 responsive to the ultraviolet rays, for example, may contain: an electron donor material, such as about 0.01 to 1 percent by weight of bis-1,4-dimethylphenyl (-1,4-diphenyl (butatriene)) or 2 to 5 percent by weight of tetraphenylethylene (TPE); an electron acceptor material, such as about 0.01 to 1 percent by weight of at least one of trinitrofluorenone (TNF) and ethylanthraquinone (EAQ); a polymeric binder, such as 1 to 30 percent by weight polystyrene (PS); and a solvent such as the remaining percent by weight of toluene or xylene.

Meanwhile, Japan Patent Laid-open publication No. PYUNG 08-236036, published on Sep. 13, 1996, discloses "DISPLAY SURFACE AND ITS MANUFACTURING METHOD", wherein, as shown in FIG. 5, both an inner-surface anti-reflection film 1 formed over the whole area of a faceplate 18, and a pigment-particle layer 1 formed only beneath a black pigment layer 2 contain silicon oxide particles, have an interference effect of a reflection light of a incident outer light and an absorption effect of a dispersion light of the incident outer light, thereby sufficiently preventing reflection of the incident outer light and improving contrast. Accordingly, the color purity and brightness of the faceplate 18 with higher transmissivity of light can be improved.

The inner-surface anti-reflection film or the pigment-particle layer 1 is manufactured by a conventional photolithographic wet process as shown in FIGS. 6*a* to 6*d*. That is, a resist pattern 1' as shown in FIG. 6*a* can be obtained by the steps of coating a photoresist liquid on the faceplate 18, exposing the photoresist coating through a shadowmask to a high pressurized mercury lamp and developing the exposed photoresist coating. Then, as shown in FIGS. 6*b* and 6*c*, the pigment-particle layer 1 and the black pigment layer 2 in order are coated on the resist pattern 1', and a resist-dissolving liquid containing a sulfamine acid of 10% is applied thereto, thus the resist pattern 1' is removed and the black pigment layer 2 of a matrix pattern with the pigment-particle layer 1 beneath the matrix pattern, as shown in FIG. 5, is manufactured.

Also, a blue color pigment layer, a green color pigment layer and a red color pigment layer can be formed beneath a blue color-emitting phosphor, a green color-emitting phosphor and a red color-emitting phosphor, respectively, by the above-mentioned method, thus a screen structure with a color filter formed beneath the phosphor can be obtained.

Furthermore, Japan Patent Laid-open publication No. PYUNG 08-106859, published on Apr. 23, 1996, discloses "COLOR CATHODE RAY TUBE", wherein, as shown in FIG. 7, a green color filter layer 3, a blue color filter layer 4 and a red color filter layer 5 are formed, respectively, by the above-mentioned method, and only a white color-emitting phosphor 6 is formed on the filter layers, thereby improving brightness of 10%, decreasing reflexibility of 10% and increasing productivity as compared with the prior art phosphor layer with a color filter.

However, since the methods disclosed in the aforementioned publications use a photolithographic wet process for manufacturing a filter layer, which is well known as a prior art process for forming the phosphor screen, they do not meet the higher resolution demands and require a lot of complicated processing steps and a lot of manufacturing equipments with the use of a large quantity of clean water, thereby necessitating higher cost in manufacturing the phosphor screen. In addition, a large quantity of effluent such as waste water is discharged.

Moreover, in the photolithographic wet process for forming the filter layer, conglomeration among the particles is caused due to particle dispersion and cohesion, thereby making the thickness of the filter layer un-uniform and the brightness of the phosphor screen partially different over the whole areas of the faceplate.

Furthermore, in the aforementioned dry-electrophotographically manufacturing method of a screen, the red color-emitting phosphor comprises $Y_2O_2S$:Eu/$Fe_2O_3$, the blue color-emitting phosphor ZnS:Ag/CoO.n$Al_2O_3$, the green color-emitting phosphor ZnS:Cu,Al. Thus, only $Fe_2O_3$ and CoO.n$Al_2O_3$ as red and blue pigments put in colors to the phosphors and therefore, color purity and brightness are not improved.

Therefore, the present invention has been made to overcome the above described problems, and thereby it is an object of the present invention to provide a method of electrophotographically manufacturing a viewing screen including a filter layer of pigment particles for a cathode-ray tube(CRT), which can improve its color purity and brightness in a large way.

SUMMARY OF THE INVENTION

To achieve the above objects, the present invention provides a method of electrophotographically manufacturing a luminescent screen on an inner surface of a faceplate panel for a CRT, comprising the steps of: (a) first-coating said inner surface of the panel with a volatilizable conductive layer; (b) second-coating said conductive layer with a volatilizable photoconductive layer; (c) first-establishing a substantially uniform electrostatic charge over the whole area of the inner surface of said photoconductive layer; (d) first-exposing selected areas of said photoconductive layer for developing one of first to third charged color-emitting phosphor particles to a light source through a shadow mask to discharge the charge from the selected areas of the photoconductive layer through the conductive layer; (e) first-developing the discharged, exposed areas with one kind of charged pigment particles after removing the shadow mask; (f) fixing said developed pigment particles to said photoconductive layer to form a filter layer of the one kind of pigment particles beneath said one of first to third color-emitting phosphor particles; (g) second-establishing a substantially uniform electrostatic charge over the whole area of said photoconductive layer on which the filter layer is formed in the fixing step (f); (h) second-exposing said selected areas of said photoconductive layer to the light source through the shadow mask to discharge the charge from the selected areas of the photoconductive layer; and (i) second-developing the discharged, exposed areas of the photoconductive layer with said one of first to third charged color-emitting phosphor particles after removing the shadow mask.

The method may further comprise the step of (j) repeating steps (c) to (i) for others of first to third charged color-emitting phosphor particles consecutively and respectively, subsequent to the step (i). In this method, black matrix of light-absorptive material may be formed before the first-coating step (a) or after one step of step (i) and step (j), said black matrix being able to be formed using similar steps to step (g) to (i) for charged light-absorptive material particles.

Also, in the foregoing method of the present invention, the one of first to third color-emitting phosphor particles may be one of red color-emitting phosphor particles and blue color-emitting phosphor particles, further comprising the steps of: (k) repeating steps (c) to (i) for other one of red color-emitting phosphor particles and blue color-emitting phosphor particles consecutively and respectively, subsequent to the step (i) instead of step (j); (l) establishing a substantially uniform electrostatic charge over the whole area of said photoconductive layer on which the filter layer is formed in the fixing step (f), subsequent to one of step (b), step (i) and step (k); (m) exposing selected areas of said photoconductive layer for green color-emitting phosphor particles to the light source through the shadow mask to discharge the charge from the selected areas of the photoconductive layer; and (n) developing the discharged, exposed areas of the photoconductive layer with charged green color-emitting phosphor particles after removing the shadow mask. In this method, black matrix of light-absorptive material may be formed before the first-coating step (a) or after one step of step (i), step (k) and step (n), and be formed using similar steps to step (g) to (i) for charged light-absorptive material particles.

The method according to the present invention may further comprise at least one step of fixing said developed three color-emitting phosphor particles and black matrix to the photoconductive layer.

Said pigment particles may be $Fe_2O_3$ for red color-emitting phosphor particles, and CoO.n$Al_2O_3$ for blue color-emitting phosphor particles.

The present invention further provides a CRT comprising a luminescent viewing screen with filter layers, which is formed on an inner surface of a faceplate panel using the above-mentioned electrophotographically manufacturing process according to the present invention.

BRIEF DESCRIPTION OF THE DRAWINGS

The above object, and other features and advantages of the present invention will become more apparent by describing in detail preferred embodiments thereof with reference to the attached drawings, in which.

DETAILED DESCRIPTION OF THE PREFERRED EMBODIMENT

Figure 1:
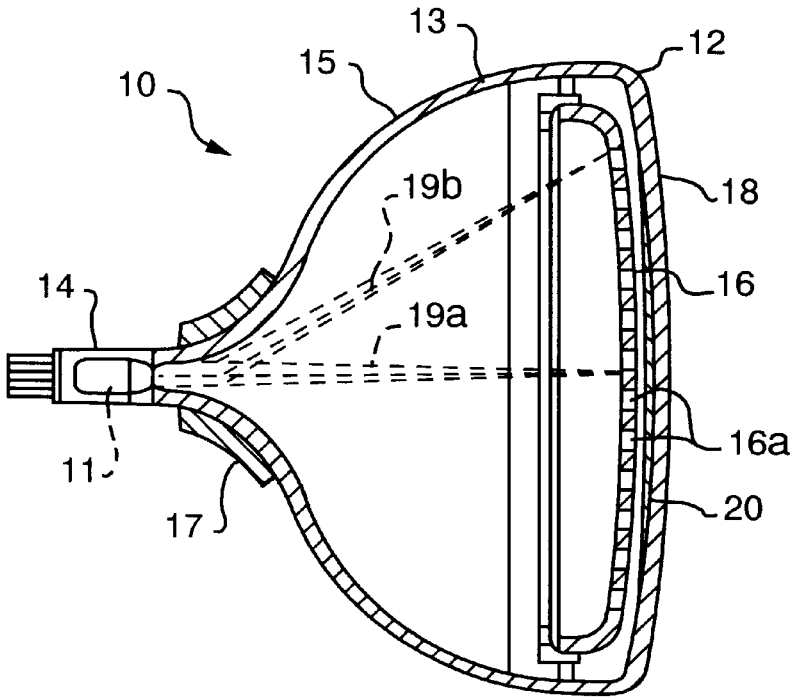
FIG. 1 is a plan view partially in axial section of a color cathode-ray tube.
Figure 2:
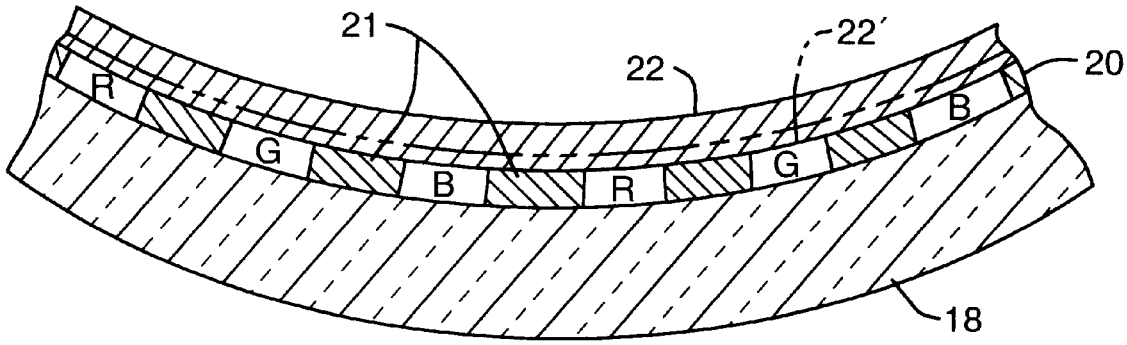
FIG. 2 is a section of a screen assembly of the tube shown in FIG. 1.
Figure 3A:
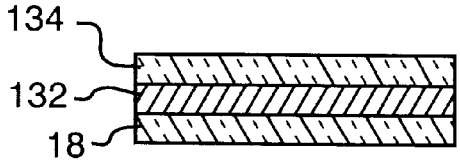
FIGS. 3*a* through 3*e* show various steps in electrophotographically manufacturing the screen assembly of the tube according to the present invention by viewing a portion of a faceplate having a conductive layer and an overlying photoconductive layer.
Figure 3B:
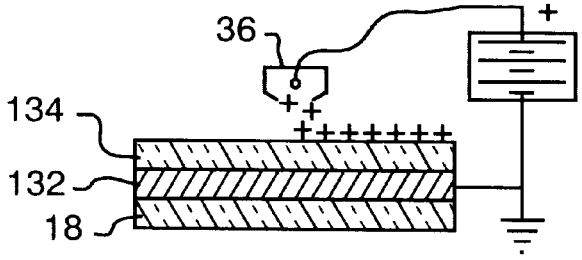
Figure 3C:
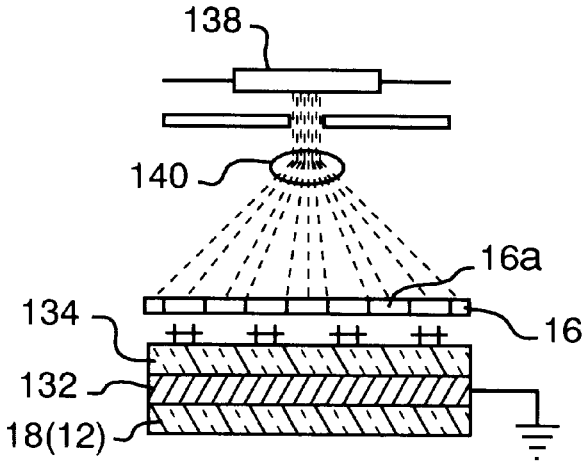
Figure 3D:
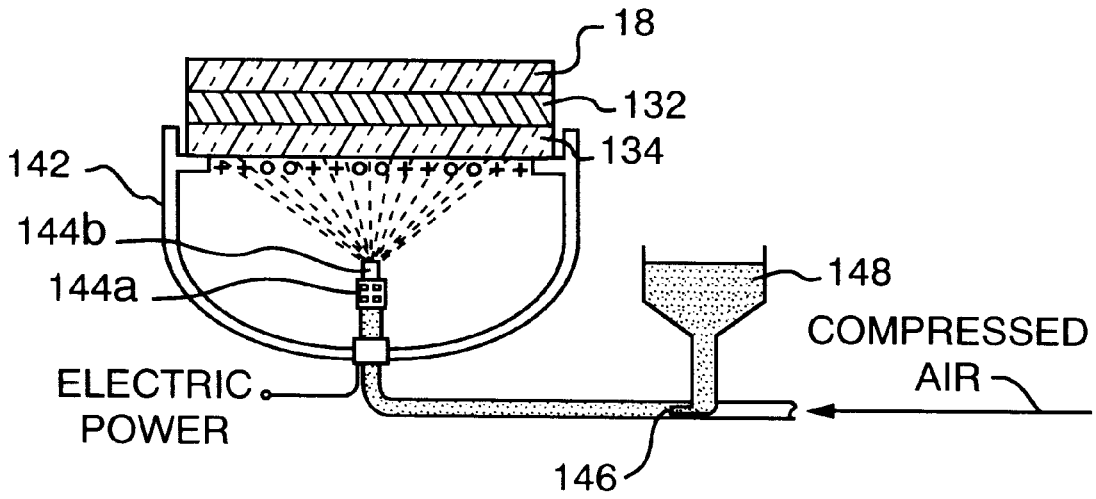
Figure 3E:
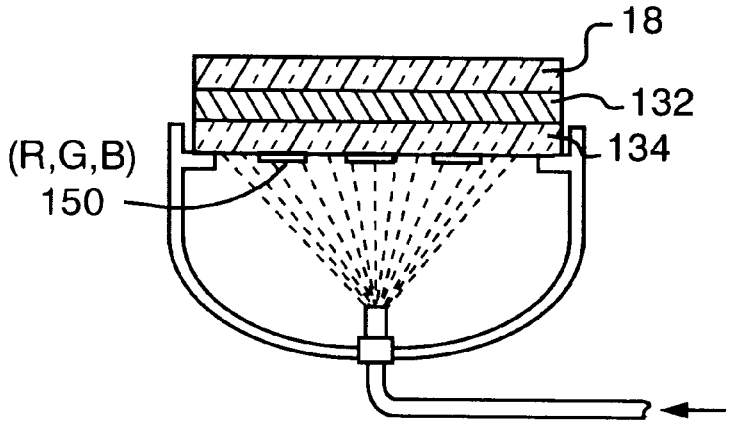
Figure 4:
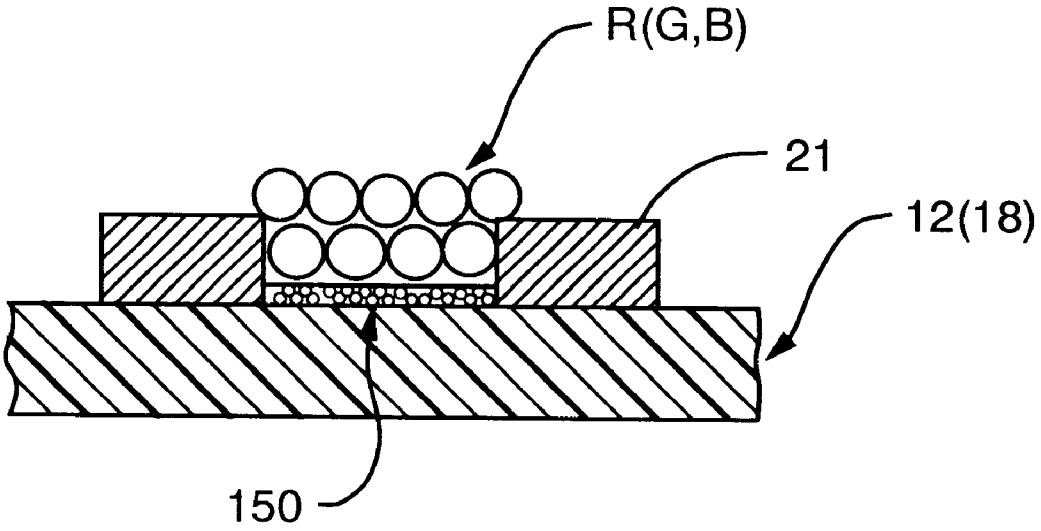
FIG. 4 is an enlarged section, in partial, of a screen assembly of the tube according to the present invention.
Figure 5:
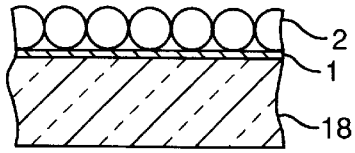
FIG. 5 (PRIOR ART)
FIG. 5 is an enlarged section, in partial, of a screen assembly of the tube according to one prior art.
Figure 6A:
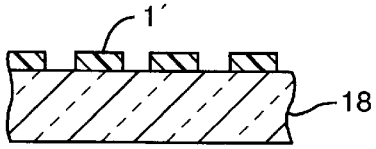
FIG. 6A (PRIOR ART)
FIGS. 6*a* to 6*d* show various steps in photolithographic wet process of manufacturing the screen assembly of the tube including a filter layer in accordance with the prior art by viewing a portion of a faceplate.
Figure 6B:
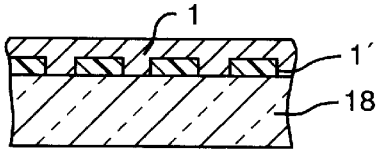
FIG. 6B (PRIOR ART)
Figure 6C:
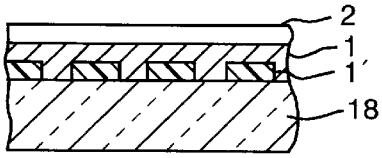
FIG. 6C (PRIOR ART)
Figure 6D:
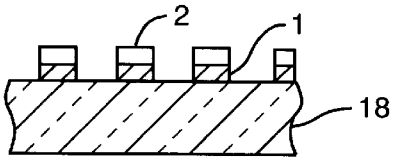
FIG. 6D (PRIOR ART)
Figure 7:
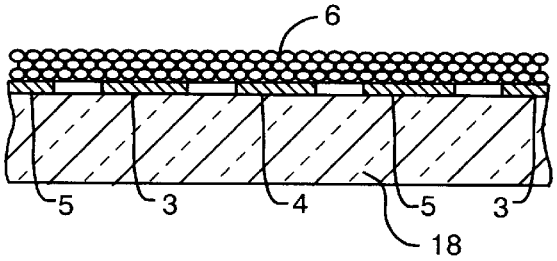
FIG. 7 (PRIOR ART)
FIG. 7 is an enlarged section, in partial, of a screen assembly of the tube according to another prior art.

FIGS. 3*a* through 3*e* schematically show various steps in a novel manufacturing method of a screen with a filter layer in accordance with the present invention and FIG. 4 shows an enlarged partial section of a novel screen structure electrophotographically manufactured by the present invention..

FIG. 3*a* represents first and second coating steps, showing a portion of a faceplate 18, on the inner surface of which an electrically conductive layer 132 is formed on the inner surface of the faceplate 18 and a photoconductive layer 134 sequentially overlies the conductive layer 132.

The conductive layer 132 can be formed by conventionally applying a volatilizable organic conductive material consisting of about 1 to 50 weight % of a polyelectrolyte commercially known as CATLFOC-C, available from Calgon Co., Pittsburgh, Pa., to the inner surface of the faceplate 18 in an aqueous solution containing about 1 to 50 weight % of 10% poly vinyl alcohol and drying the solution, said conductive layer 132 serving as an electrode for the overlying photoconductive layer 134. Then, the photoconductive layer 134 is formed by conventionally applying to the conductive layer 132 a photoconductive solution containing ultraviolet-sensitive material and drying it.

The photoconductive solution responsive to the ultraviolet rays, for example, contains an electron donor material, such as about 0.01 to 1 percent by weight of bis-1,4-dimethyl phenyl (1,4-diphenyl (butatriene)) or 2 to 5 percent by weight of tetraphenyl ethylene; an electron acceptor material, such as about 0.01 to 1 percent by weight, respectively, of at least one of trinitro-fluorenone (TNF) and ethyl anthraquinone (EAQ); a polymeric binder, such as 1 to 30 percent by weight polystyrene; and a solvent such as the remaining percent by weight of toluene or xylene.

As the polymeric binder, poly(alpha-methylstyrene) (PaMS), polymethylmethacrylate (PMMA), and polystyrene-oxazoline copolymer (PS-OX), etc., may be employed instead of the polystyrene.

The conductive layer 132 and the photoconductive layer 134 may be formed as described in U.S. Pat. No. 4,921,767, cited above.

FIG. 3*b* schematically illustrates a first-charging step, in which, after the first and second coating steps, the whole surface of said photoconductive layer 134 is positively charged on the photoconductive layer 134 by applying below about 1 kilo-volts, preferably about +400 volts, in a direct current with a corona discharger 36 and moving the corona discharger 36 across the photoconductive layer 134 with a constant gap therebetween. The charging step does not require a dark environment since the photoconductive layer 134 is sensitive to ultraviolet rays below about 450 nm of wave length.

FIG. 3*c* schematically shows a first-exposing step, wherein the shadow mask 16 is inserted in the panel 12 and, in order to discharge the charges from the positively charged photoconductive layer 134 selectively for areas of the photoconductive layer 134 on which one of first to third color-emitting phosphor particles is developed, the photoconductive layer 134 is exposed to a light source through the shadow mask 16, having a latent charge image of a predetermined array pattern.

That is, the positively charged photoconductive layer 134 is selectively exposed through an ultraviolet-transmissive lens system 140 and apertures or slits 16*a* of the shadow mask 16 to the ultraviolet rays from a ultraviolet lamp 138. The charges of the exposed areas are discharged through the grounded conductive layer 132 and the charges of the unexposed areas remain in the photoconductive layer 134, thus establishing the latent charge image. This exposing step also does not require a dark environment since the ultraviolet rays are used.

Thus, after the first-exposing step, the selectively-discharged, exposed areas of the photoconductive layer 134 is developed with one kind of charged pigment particles after removing the shadow mask as shown in FIG. 3*d* (first-developing step).

FIG. 3*d* diagrammatically illustrates the outline of a first-developing step. The dry-powdered pigment particles are suitably charged, and sprayed by compressed air toward the photoconductive layer 134. The dry-powdered particles are transferred by compressed air through a venturi tube 146 from a hopper 148 to a nozzle 144*b* to be sprayed. Below the-nozzle 144*b*, there is provided a discharge electrode 144*a* such as a corona discharger. The discharge electrode 144*a* charges the dry-powdered particles so that the charged dry-powdered particles may be sprayed from the nozzle 144*b* toward the photoconductive layer 134. The charged dry-powdered particles are attracted to one of the areas, exposed or unexposed at said first-exposing step, on the photoconductive layer 134. The polarity of dry-powdered particles charged by the discharge electrode 144*a* is determined according to which areas the dry-powdered particles are desired to be attached on. That is, if the dry-powdered particles are desired to be attached to the positive charged, i.e., unexposed areas, they are negatively charged by the discharge electrode 144*a*. While if the dry-powdered particles are desired to be attached to the discharged, i.e., exposed areas, they are positively charged. And hence the dry-powdered particles, which are charged positively or negatively and sprayed into the developing container 142, can be attached strong to the surface of the photoconductive layer 134 in a predetermined array pattern due to electrical attraction or repulsion.

Then, after the first-developing step, the developed pigment particles are fixed on the photoconductive layer 134 to form a filter layer 150 as shown in FIG. 4 (first-fixing step).

FIG. 3*e* schematically illustrates the first-fixing step using a liquid electrostatic spray gun. In this first-fixing step,. the surface of the photoconductive layer 134, on which the particles are attached in the predetermined array pattern at said fist-developing step, is sprayed by solvent of petroleum such as xylene, toluene, TCE, methyl isobutyl ketone (MIBK), etc. Then, at least polymers contained in the photoconductive layer 134 are dissolved. And the dry-powdered particles, deposited on the developed areas of the photoconductive layer 134 due to electrical forces, are fixed by adhesion of said dissolved polymers. A vapor swelling method also may be used in this fixing step. In the vapor swelling method, the particles deposited on the developing areas of the photoconductive layer 134 are fixed by being in contact with solvent vapor such as acetone, methyl isobutyl ketone. Also, fixing step disclosed in U.S. Pat. No. 4,921,767 can be used in the first-fixing step.

Thus, before the phosphor particles are developed, the filter layer 150 is formed beneath said one of first to third color-emitting phosphor particles.

Again, in order to develop the one of first to third color-emitting phosphor particles, whole surface of said photoconductive layer 134 is secondly charged to charge said photoconductive layer 134 with constant positive charges, similarly to the first-charging step and as shown in FIG. 3*b* (second-charging step). Then, a second-exposing step is performed as shown in FIG. 3*c,* wherein the filter-layer-fixed areas of the positively charged photoconductive layer 134 is selectively exposed through an ultraviolet-transmissive lens system 140 and apertures or slits 16*a* of the shadow mask 16 to the ultraviolet rays from a ultraviolet lamp 138, similarly to the first-exposing step. Sequentially, the second-developing step is performed similarly to the first-developing step, wherein the selectively-discharged, exposed areas of the photoconductive layer 134 is developed with said one of first to third color-emitting phosphor particles after removing the shadow mask, as shown in FIG. 3*d,* thus said one of first to third color-emitting phosphor particles is developed onto the filter layer 150.

Then, a fixing step may be further performed similarly to the first-fixing step so as to securely fix said one of first to third color-emitting phosphor particles on the fixed filter layer 150 and the photoconductive layer 134.

The steps of first-charging, first-exposing, first-developing, first-fixing, second-charging, second-exposing and second-developing may be repeated for other two of the first to third color-emitting phosphor particles of R, G, and B with other two pigment filter layers for completing of a CRT's screen.

On the one hand, since a filter layer for the green color-emitting phosphor particles does not improve color purity in the large scale, the filter layer 150 only for the red color-emitting phosphor particles and the blue color-emitting phosphor particles may be formed except one for the green color-emitting phosphor particles. That is, the one of .the first to third color-emitting phosphor particles may be one of red color-emitting phosphor particles and blue color-emitting phosphor particles, and repeating steps of first-charging, first-exposing, first-developing, first-fixing, second-charging, second-exposing and second-developing may be performed for other one of red color-emitting phosphor particles and blue color-emitting phosphor particles consecutively. Then, for the green color-emitting phosphor particles, steps of charging, exposing and developing may be performed again using the conventional electrophotographically manufacturing method. In this case, said pigment particles may be $Fe_2O_3$ for red color-emitting phosphor particles, and $CoO.nAl_2O_3$ for blue color-emitting phosphor particles.

In addition, the panel 12 with the black matrix 21 of light-absorptive material formed on the inner surface of the faceplate 18 before the first-coating step may be inputted into the process before the first-coating step. Otherwise, the black matrix 21 of light-absorptive material may be formed on the inner surface of the faceplate 18 after one of second-developing steps for the first to third color-emitting phosphor particles. The black matrix 21 of light-absorptive material is formed by the prior photolithographic wet process or by the electrophotographically described in U.S. Pat. No. 4,921,767, cited above.

The fixing step may be performed after last developing step for said three color-emitting phosphor particles and black matrix, or may be performed after each developing step for said three color-emitting phosphor particles R, G and B, and the black matrix 21 to the photoconductive layer 134 in order to securely fix said developed three color-emitting phosphor particles and black matrix to the photoconductive layer.

Thus, after the patterns of phosphor particles R, G and B, with filter layers 150, and the matrix of light-absorptive material have been formed, the resin or lacquer film 22' is formed at a conventional lacquer process. And then, the aluminum thin film 22 is also formed conventionally at a conventional aluminizing process. Then, the faceplate panel 12 is baked in air at temperature of about 425 degrees of centigrade for about 30 minutes. This baking process drives off the volatilizable constituents of solvents, etc., present in the conductive layer 132, the photoconductive layer 134, the respective phosphors R, G, and B, or lacquer film 22', etc. Thereby, the phosphor screen 20 with the filter layer 150 formed beneath all the phosphor elements R, G and B, or at least both the phosphor elements R and B by the dry-electrophotographically manufacturing process, as shown in FIG. 4, can be obtained.

Therefore, when the electron beams impinge on each color-emitting phosphor, color-forming light only within the range of the wave frequency or length of determined color-forming light can be passed through the filter layers 150 to the outer side of the panel 12, thereby improving its color purity.

Also, the filter layers 150 can be easily formed with a constant and thin thickness due to the application of the electrophotographically manufacturing process as compared with the prior art photolithographic wet process, thereby improving productivity and brightness in a large way.

What is claimed is:

1. A method of electrophotographically manufacturing a luminescent screen on an inner surface of a faceplate panel for a CRT, comprising:

(a) coating the inner surface of the panel with a volatilizable conductive layer;

(b) coating the volatilizable conductive layer with a volatilizable photoconductive layer;

(c) establishing a uniform electrostatic charge over the whole area of the inner surface of the photoconductive layer;

(d) exposing selected areas of the photoconductive layer for later developing one of first to third color-emitting phosphor particles, to a light source through a shadow mask to discharge the charge from the selected areas of the photoconductive layer through the conductive layer;

(e) removing the shadow mask;

(f) developing the discharged selected areas with pigment particles;

(g) fixing the pigment particles to the photoconductive layer to form a filter layer of the pigment particles before developing the one of the first to third developed color-emitting phosphor particles over the filter layer;

(h) establishing a second uniform electrostatic charge over the whole area of the inner surface of the photoconductive layer on which the filter layer of step (g) is fixed;

(i) again exposing the selected areas of the photoconductive layer to a light source through the shadow mask to discharge the charge from the selected areas of the photoconductive layer;

(j) again removing the shadow mask; and (k) developing the discharged selected areas with the one of the first to third color-emitting phosphor particles.

2. The method of claim 1, further comprising the step of:

(l) repeating steps (c) to (k) for others of first to third charged color-emitting phosphor particles consecutively and respectively, subsequent to the step (k).

3. The method of claim 2, including forming a black matrix of light-absorptive material on the panel before the coating step (a).

4. The method of claim 3, further comprising fixing said developed three color-emitting phosphor particles and the black matrix to the photoconductive layer.

5. The method of claim 1, wherein the one of first to third color-emitting phosphor particles is one of red color-emitting phosphor particles and blue color-emitting phosphor particles, further comprising the steps of:

(l) repeating steps (c) to (k) for other one of red color-emitting phosphor particles and blue color-emitting phosphor particles consecutively and respectively, subsequent to the step (k);

establishing a uniform electrostatic charge over the whole area of said photoconductive layer on which the filter layer is formed in the fixing step (g);

exposing selected areas of said photoconductive layer adapted for green color-emitting phosphor particles to light source through the shadow mask to discharge the charge from the selected areas of the photoconductive layer; and developing the discharged, exposed areas of the photoconductive layer with charged green color-emitting phosphor particles after removing the shadow mask.

6. The method of claim 5, including forming a black matrix of light-absorptive material on the panel before the coating step (a).

7. The method of claim 6, further comprising fixing said developed three color-emitting phosphor particles and the black matrix to the photoconductive layer.

8. The method of claim 1, wherein said pigment particles are $Fe_2O_3$ for red color-emitting phosphor particles and $CoO.nAl_2O_3$ for blue color-emitting phosphor particles, respectively.

* * * * *